US008754915B2

(12) United States Patent
Umetsu

(10) Patent No.: US 8,754,915 B2
(45) Date of Patent: Jun. 17, 2014

(54) IMAGE FORMING DEVICE

(71) Applicant: Toshiba Tec Kabushiki Kaisha, Tokyo (JP)

(72) Inventor: Toshiyuki Umetsu, Shizuoka (JP)

(73) Assignees: Kabushiki Kaisha Toshiba, Minato, Tokyo (JP); Toshiba Tec Kabushiki Kaisha, Shinagawa, Tokyo (JP)

( * ) Notice: Subject to any disclaimer, the term of this patent is extended or adjusted under 35 U.S.C. 154(b) by 0 days.

(21) Appl. No.: 13/863,704

(22) Filed: Apr. 16, 2013

(65) Prior Publication Data

US 2013/0271547 A1 Oct. 17, 2013

Related U.S. Application Data

(60) Provisional application No. 61/625,023, filed on Apr. 16, 2012.

(51) Int. Cl.
*B41J 2/32* (2006.01)
*B41J 11/00* (2006.01)

(52) U.S. Cl.
CPC ..... *B41J 11/0015* (2013.01); *B41J 11/002* (2013.01)
USPC ..... 347/179

(58) Field of Classification Search
CPC ..... B41J 11/0015; B41J 11/002
USPC ..... 347/179
See application file for complete search history.

(56) References Cited

U.S. PATENT DOCUMENTS 8,308,262 B2 * 11/2012 Yoshida et al. ..... 347/14
8,427,516 B2 * 4/2013 Kawaguchi et al. ..... 347/171
8,456,497 B2 * 6/2013 Iguchi et al. ..... 347/179

* cited by examiner

*Primary Examiner* — Huan Tran
(74) *Attorney, Agent, or Firm* — Patterson & Sheridan, LLP

(57) ABSTRACT

According to an embodiment, an image forming device has a printing unit for printing an image on a sheet, a holding unit for holding the sheet that has been printed by the printing unit, a recovery unit for recovering the sheet from the holding unit, an erasing unit for erasing the image on the sheet recovered by the recovery unit, and a control unit configured to command the recovery unit to recover the sheet held by the holding unit if a predetermined condition is met.

20 Claims, 8 Drawing Sheets

IMAGE FORMING DEVICE

CROSS-REFERENCE TO RELATED APPLICATION

This application is based upon and claims the benefit of priority from U.S. Provisional Patent Application No. 61/625,023, filed on Apr. 16, 2012; the entire contents of which are incorporated herein by reference.

FIELD

Embodiments described herein relate to an image forming device.

BACKGROUND

Conventionally, in an image forming device, paper sheets that have been printed are stacked on a paper discharge tray. The user who initiated the printing usually takes the paper sheets that are stacked on the paper discharge tray soon after the paper sheets are discharged from the image forming device. However, if the user procrastinates taking the paper sheets from the paper discharge tray, the printed paper sheets will be left unattended on the paper discharge tray for a long period of time. In situations where the image forming device are shared by a plurality of users, such as offices, schools, shops, and so on, information printed on the unattended paper sheet may be disclosed to users who did not initiate the printing. The confidentiality of the information printed on the unattended paper sheet would be compromised in such situations.

DETAILED DESCRIPTION

Embodiments reduce the situation in which printed paper sheets are left unattended for a long period of time in an image forming device.

In general, the embodiment will be described in detail with reference to the drawings.

According to embodiments of the present disclosure, the image forming device has a printing unit for printing an image on a sheet, a holding unit for holding the sheet that has been printed by the printing unit, a recovery unit for recovering the sheet from the holding unit, an erasing unit for erasing the image on the sheet recovered by the recovery unit, and a control unit configured to command the recovery unit to recover the sheet held by the holding unit if a predetermined condition is met.

Figure 1:
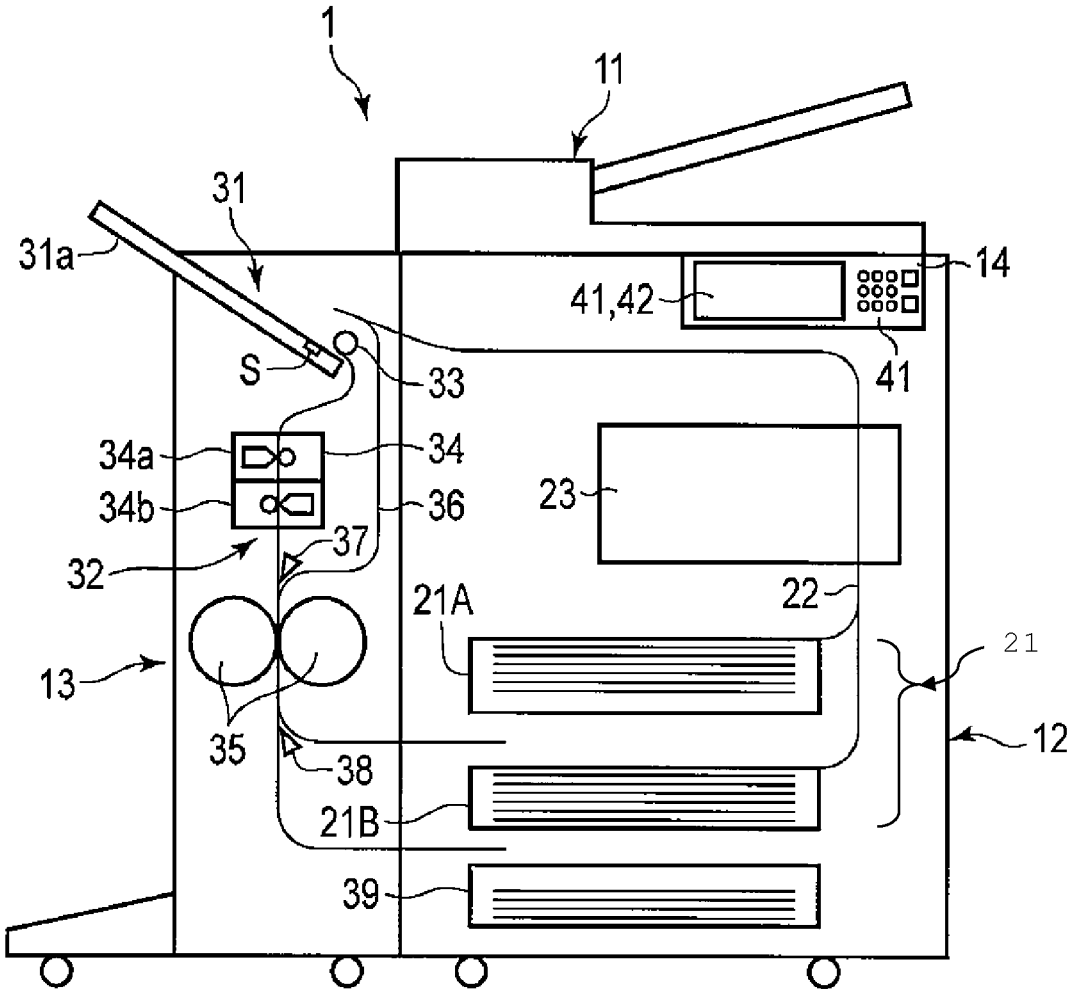
FIG. 1 is a cross-sectional diagram schematically illustrating an example of an image forming device according to embodiments of the present disclosure.

FIG. 1 is a drawing illustrating an example of a configuration of an image forming device 1.

The image forming device 1, as shown in FIG. 1, has a scanner 11, a printer 12, a finisher 13, and a control panel 14. The scanner 11, the printer 12, the finisher 13, and the control panel 14 are connected to a system control unit 50, which will be described later (see FIG. 2). The system control unit 50 controls each unit of the image forming device 1.

The scanner (a first scanner) 11 scans (reads) an image of an original document. The printer 12 performs printing processes. The printer 12 has a paper feed unit 21, a conveying unit 22, and an image forming unit 23. The paper feed unit 21 supplies a paper sheet to be printed to the image forming unit 23. The paper feed unit 21 has a plurality of cassettes 21A and 21B. Each of the cassette 21A and 21B houses several types of paper sheets that have been set within them. For example, the cassette 21B holds new paper sheets, and the cassette 21A holds paper sheets for reuse (i.e., paper sheet to which an erasing process has been carried out). The conveying unit 22 transports the paper sheets supplied from the paper feed unit 21. Thus, the conveying unit 22 conveys (transports) the paper sheets that have been fed out from the cassette 21A or 21B to the image forming unit 23.

The image forming unit 23 prints the image on the paper sheets conveyed by the conveying unit 22. The image forming unit 23 forms the images using an image forming material that can be erased (i.e., a decolorizable material). For example, the image forming unit 23 is an inkjet-type printer, an electrophotographic-type printer (laser printer), or a thermal-transfer-type printer. Furthermore, the image forming unit 23 may be a printer that prints multi-color images or the one that prints monochrome (e.g., black or blue) images. In addition, the image forming unit 23 may have an image forming unit that forms an image using both the decolorizable material and an image using an image forming material that cannot be erased (a non-decolorizable material).

The finisher 13 has a paper discharge unit 31 and an erasing unit 32. The paper discharge unit 31 holds the printed paper sheets. The paper discharge unit 31 has a paper discharge tray 31*a* and a sensor S. The paper discharge tray 31*a* holds the printed paper sheets. The sensor S detects the presence of the paper sheets on the paper discharge tray 31*a*.

The erasing unit 32 erases the image on the paper sheet. The erasing unit 32 has a recovering mechanism 33, a scanner (a second scanner) 34, an erasing mechanism 35, a reverse conveying path 36, a gate 37, a gate 38, and a reject cassette 39. The recovering mechanism 33 feeds the paper sheets from the paper discharge tray 31*a*. The recovering mechanism 33 has a recovering roller to feed the paper sheet. The second scanner 34 scans (reads) the image on the paper sheet that has been fed from the paper discharge tray 31*a*. The second scanner 34 may be a scanner that scans the image formed with the decolorizable material. The image scanned by the second scanner 34 is the information used to determine whether to erase the image on the paper sheet, to reject the paper, or to return the paper sheet to the paper discharge tray 31*a*. The gate 37 guides the paper sheet that is to be returned to the paper discharge tray 31*a* to the reverse conveying path 36. The paper sheet is then conveyed along the reverse conveying path 36 to the paper discharge tray 31*a*.

The erasing mechanism 35 erases the image on the paper sheet that is formed from the decolorizable material. Thus, the erasing mechanism 35 is a mechanism to erase the image by using the characteristics of the decolorizable material (e.g., ink, toner, or the like). For example, the color of the decolorizable material can be decolorized (erased) by heating the decolorizable material. If this thermal decolorization is used, the erasing mechanism 35 is comprised of a heating mechanism (a heating roller, a heating head, or the like) that heats the paper sheet. In addition, the erasing mechanism 35 may have a configuration that erases the image formed on the paper sheet by applying white material on the surface of the paper sheet if the paper sheet is white.

The gate 38 sorts the paper sheets that have been erased by the erasing mechanism 35 and the paper sheets that have been rejected. The gate 38 guides the paper sheets that have been erased to the cassette 21B. The gate 38 guides the paper sheets that have been rejected to the reject cassette 39. Thus, the reject cassette 39 holds the paper sheets that have been determined to be unerasable.

The control panel 14 is a user interface. The control panel 14 has a control unit 41 and a display unit 42. The control unit 41 has hard keys, such as ten keys, and touch keys (icons) that are incorporated in the display of the display unit 42. The user can control the image forming device by pushing or touching the keys. The display unit 42 displays messages regarding the operation of the image forming device 1.

Next, the configuration of the control system in the image forming device 1 will be explained.

Figure 2:
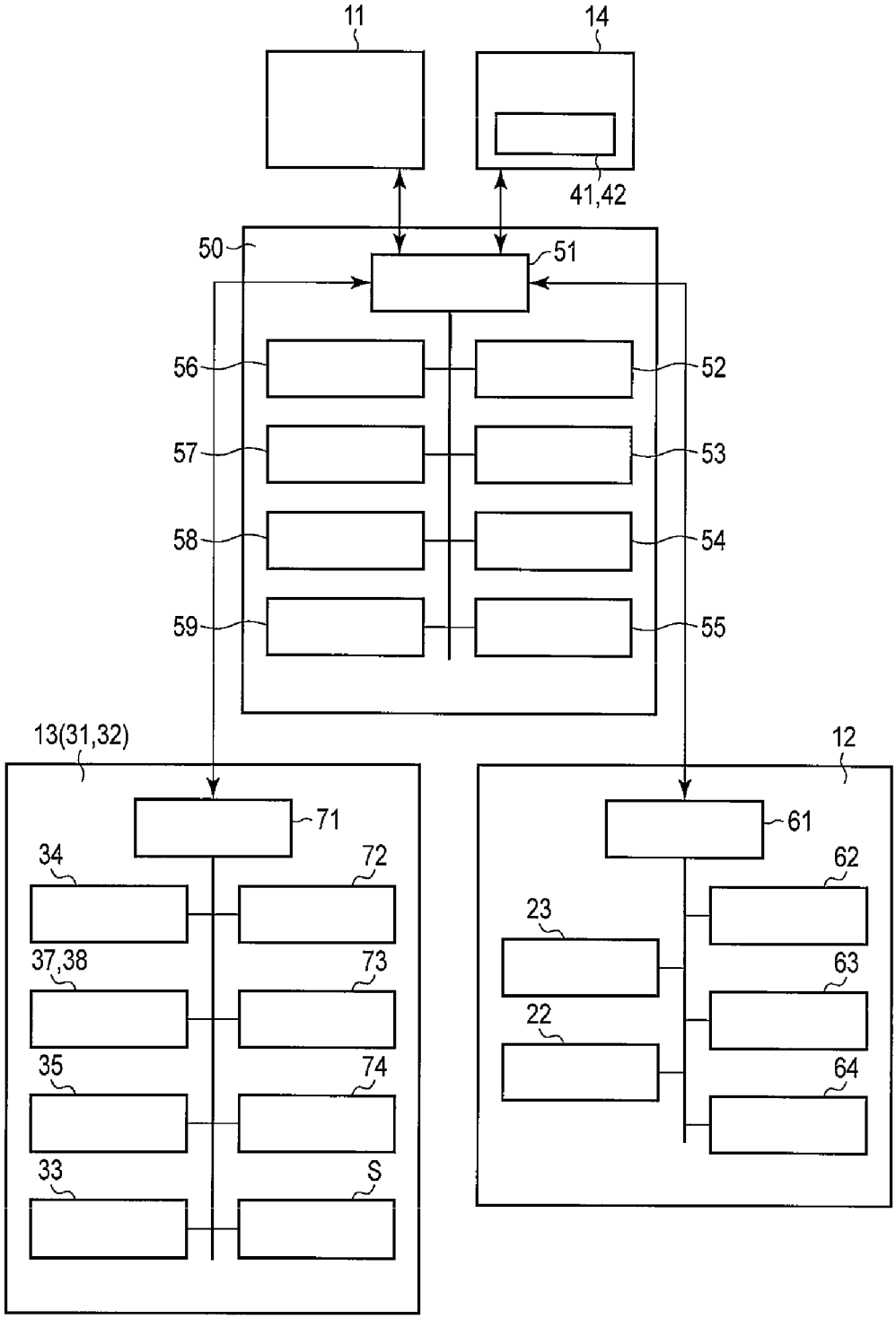
FIG. 2 is a block diagram for explaining an example of a control system of an image forming device of the embodiments.

FIG. 2 is a block diagram illustrating an example of the configuration of the control system disposed in the image forming device 1.

The system control unit 50 has a processor (system CPU) 51, a RAM 52, a ROM 53, a nonvolatile memory (NVM) 54, a hard disk drive (HDD) 55, a page memory 56, an external interface (I/F) 57, an image processing unit 58, and a clock 59.

The processor 51 is directed to control the units of the image forming device, such as the paper feed unit 21, the conveying unit 22, the image forming unit 23, the paper discharge unit 31, and the erasing unit 32. The processor 51 is a processor that executes operations by carrying out control programs. The processor 51 is connected to the units in the image forming device 1 via system buses. For example, the processor 51 is connected to the scanner 11, the printer 12, the finisher 13, and the control panel 14 via the system bus. The processor 51 communicates bi-directionally with the scanner 11, the printer 12, the finisher 13, and the control panel 14.

The RAM 52 is a volatile memory. The RAM 52 functions as a working memory or a buffer memory. The ROM 53 memorizes the control programs and control data, and the like. The system CPU 51 conducts a variety of operations by executing the control programs stored in the ROM 53 (or the NVM 54 or the HDD 55).

The nonvolatile memory (NVM) 54 is a rewritable nonvolatile memory. The nonvolatile memory 54 stores the control programs that will be executed by the processor 51 and the control data. In addition, the nonvolatile memory 54 stores setting information, operational requirements, and the like. The HDD 55 is a large-capacity storage device. The HDD stores the image data, the log data, and the like. Furthermore, the HDD 55 may store the control programs, the control data, and the like, or the HDD may store setting information, operational requirements, and the like. The page memory 56 stores the image data subjected to the image operation.

The external interface (I/F) 57 is an interface for communicating with external devices. For example, the external interface 57 receives a print request from an external device. The external interface 57 may be an interface that gives data notification to the external device. For example, the external interface 57 may be connected locally to the external device or connected to a network interface via a network.

The image processing unit 58 functions as an image processing unit for carrying out image processing of the image data read by the scanner 11, a compression and decompression unit for performing compression and decompression of the image data read by the scanner 11, and an image processing unit for generating image data to be printed by the printer 12. The clock 59 tracks elapsed time. The clock 59 may also have a feature of showing a current time.

The printer 12 has a processor (printer CPU) 61, a RAM 62, a ROM 63, a nonvolatile memory (NVM) 64, the conveying unit 22, and the image forming unit 23. The processor 61 conducts operations by executing control programs. The processor 61 is connected to each unit disposed in the printer 12 via system buses or the like. The printer CPU 61 controls the operation of each unit in the printer 12 according to the operating instruction transmitted from the system CPU 51.

The RAM 62 is a volatile memory. The RAM 62 functions as a working memory or a buffer memory. The ROM 63 stores the control programs, the control data, and the like. The printer CPU 61 conducts a variety of operations by executing the control programs stored in the ROM 63 (or the NVM 64). The nonvolatile memory (NVM) 64 is a re-writable nonvolatile memory.

The conveying unit 22 has a pickup roller, a conveying roller, a gate, and the like (not shown in FIGS. 1, 2). The pickup roller, the conveying roller, and the gate of the conveying unit 22 are controlled by the processor 61 according to the operating instruction transmitted from the processor 61. The image forming unit 23 forms the image on the paper sheet that is conveyed by the conveying unit 22 according to the operating instruction transmitted from the processor 61.

The finisher 13, which is comprised of the paper discharge unit 31 and the erasing unit 32, has a processor (finisher CPU) 71, a RAM 72, a ROM 73, a nonvolatile memory (NVM) 74, a sensor S, the recovering mechanism 33, the scanner 34, the erasing mechanism 35, and the gates 37 and 38. The processor 71 conducts operations by executing control programs. The processor 71 is connected to each unit disposed in the finisher 13 via system buses or the like. The processor 71 controls the operation of each unit in the finisher 13 according to the operating instruction transmitted from the processor 51 of the system control unit 50.

The RAM 72 is a volatile memory. The RAM 72 functions as a working memory or a buffer memory. The ROM 73 stores the control programs, the control data, and the like. The processor 71 conducts a variety of operations by executing the control programs stored in the ROM 73 (or the NVM 74). The nonvolatile memory (NVM) 74 is a re-writable nonvolatile memory.

The sensor S outputs to the processor 71 or the processor 51 a detection signal indicating that a paper sheet is put on the paper discharge tray 31*a*. The recovering mechanism 33 feeds the paper sheet from the paper discharge tray 31*a* according to the instruction from the processor 71. The scanner 34 scans the paper sheet and creates an image data corresponding to the scanned image according to the instruction from the processor 71. The scanner 34 transfers the image data to the system control unit 50. The erasing mechanism 35 carries out an erasing process to the paper sheet according to the instruction from the processor 71. The gates 37 and 38 are each driven according to the instruction from the processor 71.

Furthermore, the system control unit 50 saves in the HDD 55 the image data of the paper sheet scanned by the scanner 34. The image processing unit 58 of the system control unit 50 analyzes the image data transferred from the scanner 34. For example, the image processing unit 58 determines, according to the analysis of the image data, whether to carry out the erasing process on the paper sheet, to reject the paper sheet, or to return the paper sheet back to the paper discharge tray. The image processing unit 58 may be configured to determine the erasing status (the remainder of the erase) of the image on the paper sheet according to the analysis of the image data. The processor 51 outputs the operating instruction to the finisher 13 based on the determination result by the image processing unit 58.

Next, the printing process in the image forming device 1 will be explained.

The image forming device 1 carries out the printing process according to the print request from the external device (a PC or the like). Thus, the external interface 57 of the system control unit 50 receives the print data from the external device. The processor 51 of the system control unit 50 stores the print data received from the external device in the HDD 55. The processor 51 controls the HDD so that the print data will be saved in the HDD 55 for a prescribed period of time (for example, one day). In addition, the processor 51 may control the HDD 55 so that a predetermined amount of print data is retained in the HDD 55.

The HDD 55 may store the print data even after the printing process corresponding to the print data has been executed, so that the print data can be used in a printing process again. In addition, the print data stored in the HDD 55 is not limited to the print data transmitted from the external device. The HDD 55 may save print data transmitted from the scanner 11 so that the image is printed during a copying process.

If the print data is transmitted from the external device, the processor 51 carries out a printing process based on the transmitted print data. The processor 51 sets the setting of the printer 12 according to the print setting included in the print data. The printer 12 prints on a paper sheet the image corresponding to the print data. The printer 12 then discharges the printed paper sheet to the paper discharge tray 31*a*. The paper sheet discharged to the paper discharge tray 31*a* will be left unattended until the user comes to pick up the printed paper sheet. The sensor S detects the presence of the paper sheet on the paper discharge tray 31*a* (i.e., the state of whether the user has claimed the paper sheet or not).

Next, the step of ending the printing operation in the image forming device 1 will be explained.

The image forming device 1 recovers the paper sheet held on the paper discharge tray 31*a* after the completion of the printing operation if predetermined conditions are met. Examples of the recovery operation (i.e., a first, second, and third recovery operations), which will be explained below, are applicable to the image forming device 1 as the recovery process for recovering the paper sheet held on the paper discharge tray 31*a*.

First, the first recovery operation will be explained.

In the first recovery operation, the image forming device 1 recovers the paper sheet that has been put on the paper discharge tray 31*a* for or more than a prescribed amount of time. The image forming device 1 performs an erasing process for the image on the reusable paper sheet (i.e., a paper sheet the image of which is to be erased), among the paper sheets that have been recovered. The image forming device 1 stores the paper sheet, the image on which has been erased, in the cassette for reusable paper sheets. Furthermore, the image forming device 1 stores non-reusable paper sheets, among the paper sheets that have been recovered, in the cassette for rejected paper sheet.

Figure 3:
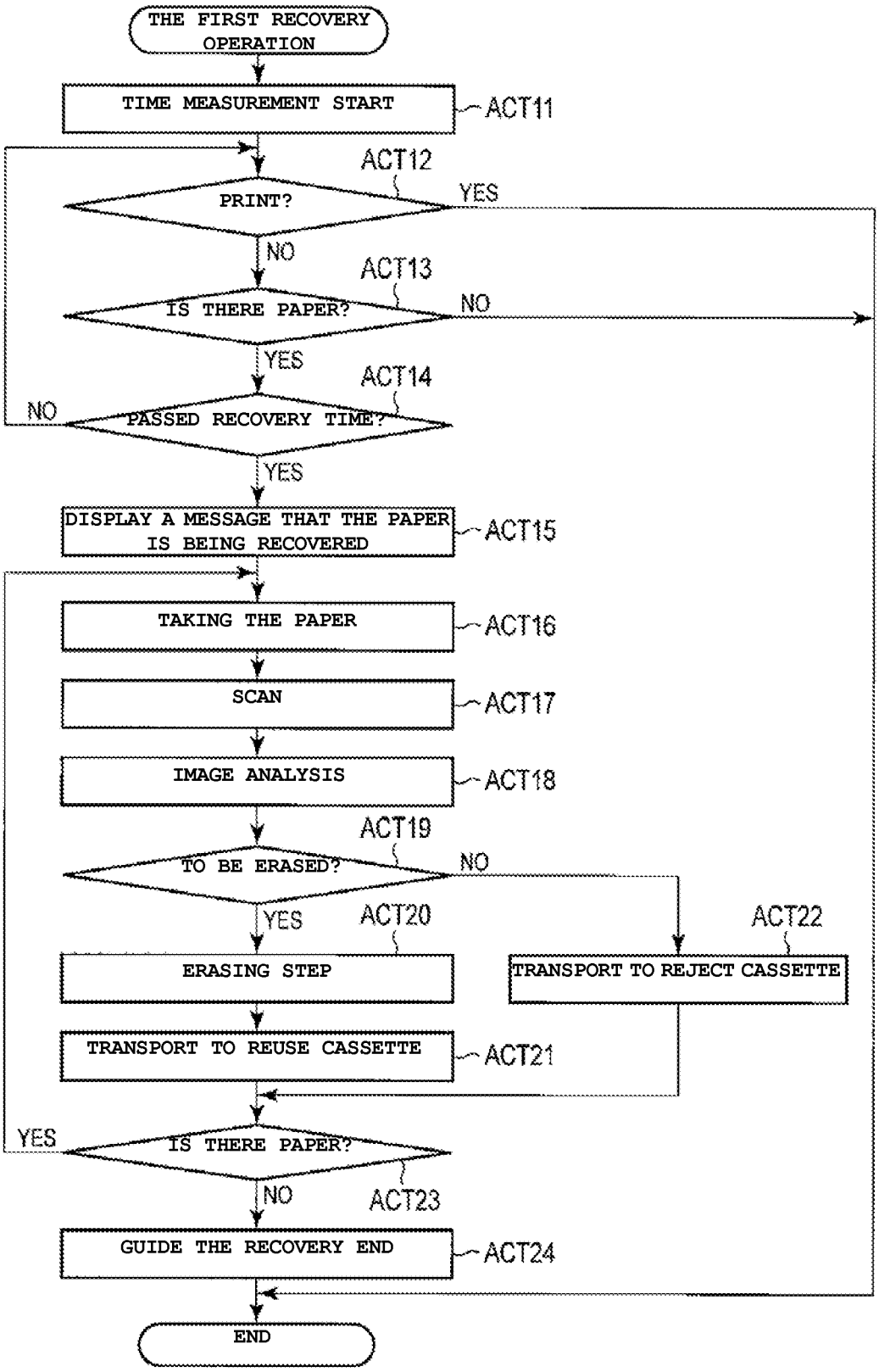
FIG. 3 is a flow chart for explaining an example of a first recovery operation of the image forming device.

FIG. 3 is a flow chart for explaining an example of the first recovery operation in the image forming device 1.

If the printing process is completed, the processor 51 of the system control unit 50 starts measuring an elapsed time using the clock 59 (ACT 11). The elapsed time is the time that has elapsed since the printing process is completed. Thus, the elapsed time substantially equals to the time that has elapsed since the printed paper sheet is discharged to the paper discharge tray 31*a*. If another printing process started (ACT 12, YES), the processor 51 stops measuring the elapsed time and skips the recovery process. The processor 51 newly starts measuring the elapsed time and starts the recovery process each time the printing process has completed.

During the time period in which the printing process is not carried out, i.e., the period of continuous idling (ACT 12, NO), the processor 51 checks the presence of the paper sheet on the paper discharge tray 31*a* (ACT 13). For example, the processor 51 monitors the presence of the paper sheet on the paper discharge tray 31*a* by the detection signal transmitted from the sensor S, which is provided in the paper discharge tray 31*a*. If no paper sheet is on the paper discharge tray 31*a* (ACT 13, NO), the processor 51 stops measuring the elapsed time (the recovery process). For example, when the user picks up the paper sheet from the paper discharge tray 31*a*, the image forming device 1 detects that no paper sheet is put on the paper discharge tray 31*a* and skips the recovery process.

If the sensor detects a paper sheet on the paper discharge tray 31*a* (ACT 13, YES), the processor 51 checks whether the elapsed time excesses a predetermined time (a recovery time) (ACT 14). If the elapsed time has not passed the recovery time (ACT 14, NO), the operation process returns to ACT 12.

ACT 13 and ACT 14 may be reversed. Thus, the processor 51 may be configured to detect the presence of the paper sheet on the paper discharge tray 31*a* if the elapsed time exceeds the recovery time.

If the elapsed time exceeds the recovery time (ACT 14, YES), the processor 51 commands the display unit 42 to display a message that the recovery of the paper sheet on the paper discharge tray 31*a* will be started (or the paper is being recovered) (ACT 15). In addition, if the elapsed time exceeds the recovery time (ACT 14, YES), the processor 51 commands the recovering mechanism 33 to convey (recover) the paper sheet on the paper discharge tray 31*a* into the finisher 13 (ACT 16).

Specifically, the recovering mechanism 33 conveys the recovered paper sheet to the scanner 34. The scanner 34 reads the image on the recovered paper sheet (ACT 17). The scanner 34 transfers to the system control unit 50 image data (i.e., data of the image read from the paper sheet). The image processing unit 58 of the system control unit 50 analyzes the image data (the read image data) transferred from the scanner (ACT 18). In the first recovery operation, the image processing unit 58 determines whether the content of the paper sheet needs to be erased (i.e., the paper sheet is for reuse) or the paper sheet needs to be rejected by analyzing the image data.

If the image processing unit 58 determines that the content on the paper sheet is to be erased (ACT 19, YES), the processor 51 notifies the processor 71 that the content of the paper needs to be erased. After receiving the notice, the processor 71 carries out the erasing process on the paper sheet by using the erasing mechanism 35 (ACT 20). The processor 71 controls the gate 38 so that the paper sheet passing through the erasing mechanism 35 is guided to the cassette for reuse 21B. Therefore, the finisher 13 conveys the paper sheet the content of which has been erased by the erasing mechanism 35 to the cassette for reuse 21B (ACT 21).

If the image processing unit 58 determines that the content of the paper sheet cannot be erased (i.e., the paper sheet is rejected) (ACT 19, NO), the processor 51 notifies the processor 71 that the paper sheet is the rejected paper sheet. After receiving the notice, the processor 71 of the finisher 13 controls the gate 38 so that the paper sheet passing through the erasing mechanism 35 is guided to the reject cassette 39. Therefore, the finisher 13 conveys the paper sheet to the reject cassette 39 (ACT 22).

If the paper sheet has been transported to the cassette for reuse 21B or the reject cassette 39, the processor 51 determines whether a paper sheet is still on the paper discharge tray 31*a* (ACT 23). If the processor 51 determines that the paper sheet is still on the paper discharge tray 31*a, i* i.e., the paper sheet remains on the paper discharge tray 31*a* (ACT 23, YES), the operation process returns to ACT 16 and the recovering mechanism 33 recovers the next paper sheet on the paper discharge tray 31*a*. On the other hand, if the processor 51 determines that no paper sheet is on the paper discharge tray 31*a*, i.e., no paper sheet remains on the paper discharge tray 31*a* (ACT 23, NO), the processor 51 commands the display unit 42 to display a message that paper sheet on the paper discharge tray 31*a* has been recovered (ACT 24).

Figure 4:
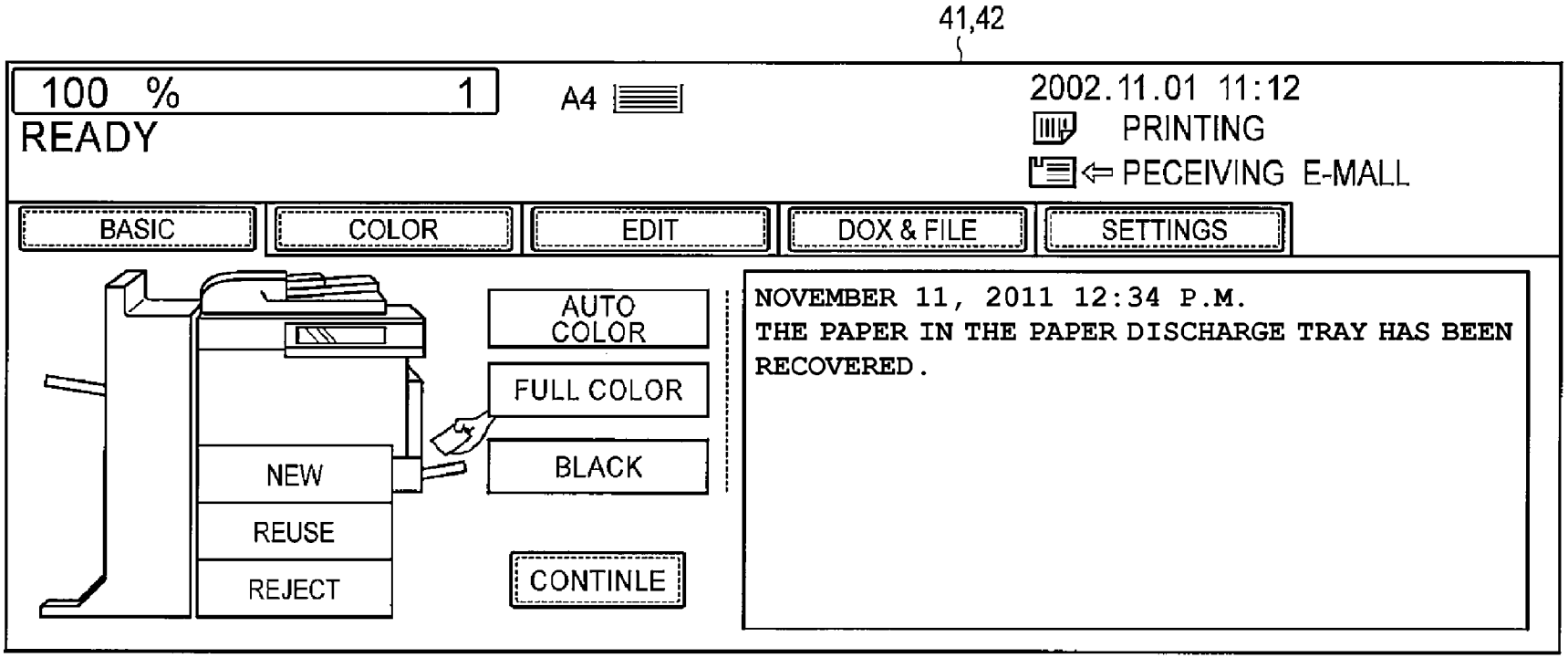
FIG. 4 is an example of a message displayed on a display unit.

For example, the display unit 42 is configured to display the number of paper sheets that have been recovered, the number of paper sheets the content of which have been erased, the number of paper sheets that have been rejected, and the recovery time, in addition to the message that the paper sheet on the paper discharge tray has been recovered. FIG. 4 is an example of the recovery message displayed on the display unit 42. In the example shown in FIG. 4, the display unit 42 of the control panel 14 displays the message that the paper sheet on the paper discharge tray 31*a* has been recovered and the recovery time associated with the paper sheet.

The image forming device applying the first recovery operation recovers the paper sheet on the paper discharge tray if a predetermined recovery time has passed since the paper sheet is discharged on the paper discharge tray. Further, the image forming device reads the image on the recovered paper sheet and determines whether the recovered paper sheet is apt for reuse or is rejected based on the read image. If the image forming device has determined that the recovered paper sheet is for reuse, the image forming device will erase the image on the paper sheet and store the paper sheet in the cassette for reuse. In addition, if the image forming device determined that the recovered paper sheet is the paper sheet to be rejected, the image forming device will store the paper sheet in the cassette for rejection.

According to the image forming device applying the first recovery operation, the paper sheet that has been printed can be prevented from being left unattended for a time exceeding the recovery time in the paper discharge tray. Further, the paper sheet on which confidential information has been printed cannot be left unattended for a long period of time in the paper discharge tray, thus improving security of the information.

Next, the second recovery operation will be explained.

Figure 5:
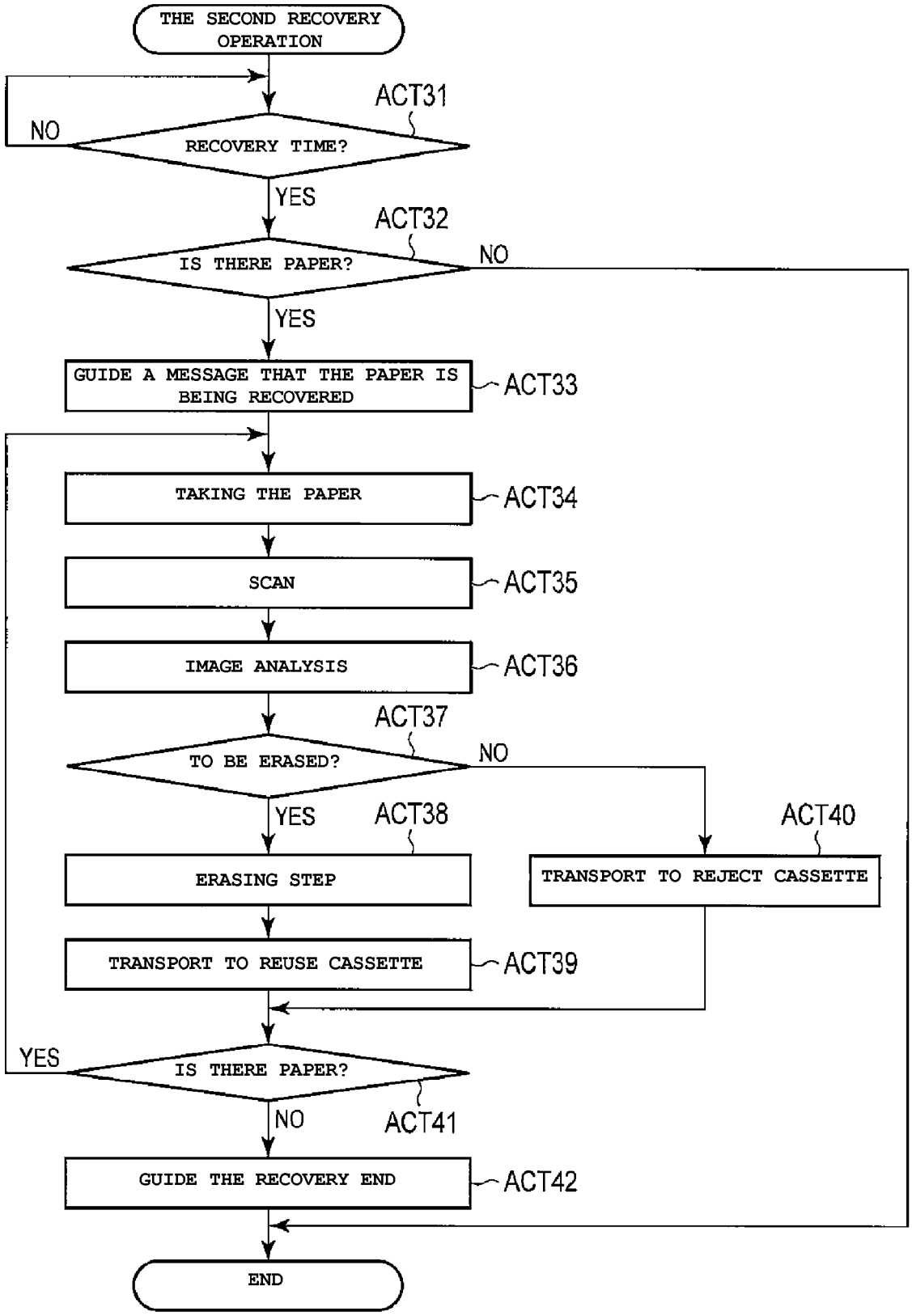
FIG. 5 is a flow chart for explaining an example of a second recovery operation of the image forming device.

In the second recovery operation, the image forming device 1 may be configured so that the paper sheet that has been left unattended on the paper discharge tray 31*a* is recovered at a predetermined time (the recovery time). FIG. 5 is a flow chart for explaining an example of the recovery operation (the second recovery operation) of the paper sheet in the image forming device 1.

The system control unit 50 stores a time (a recovery time) for carrying out the recovery operation of the paper sheet, in the nonvolatile memory 54, and the like. The processor 51 monitors whether the current time shown by the clock 59 has reached the recovery time or not (ACT 31). The recovery time may be set to a specific time of a day, a specific time of every other day, a specific time of a specific day of a week, or a specific time in a specific hour.

If the current time reaches the recovery time (ACT 31, YES), the processor 51 determines whether the paper sheet is in the paper discharge tray 31*a* by using the detection signal transmitted from the sensor S (ACT 32). If the processor 51 has determined that the paper sheet is in the paper discharge tray 31*a* at the recovery time (ACT 32, YES), the processor 51 commands the display unit 42 to display a message that the recovery of the paper sheet in the paper discharge tray 31*a* has started (or the recovery is in progress) (ACT 33). Here, the guidance of ACT 33 may be omitted.

In addition, if the processor 51 has determined that the paper sheet is in the paper discharge tray 31*a* at the recovery time (ACT 32, YES), the processor 51 commands the recovering mechanism 33 to convey the paper sheet in the paper discharge tray 31*a* into the finisher 13 (ACT 34). Specifically, the recovering mechanism. 33 conveys the paper sheet to the scanner 34 in the finisher 13 (the erasing unit 32). The scanner 34 scans the paper sheet and reads the image on the paper sheet conveyed by the recovering mechanism 33 (ACT 35). The scanner 34 then transfers the image data of the paper sheet (the data of the read image) to the system control unit 50. The image processing unit 58 of the system control unit 50 analyzes the image data of the paper sheet (ACT 36). In the second recovery operation, the image processing unit 58 determines whether the content of the paper sheet is to be erased or the paper sheet is rejected by analyzing the image data.

If the processor has determined that the content of the paper sheet is to be erased (ACT 37, YES), the processor 51 notifies the processor 71 that the content of the paper sheet is to be erased. After receiving the notice, the processor 71 of the finisher 13 commands the erasing process to be performed on the paper sheet by the erasing mechanism 35 (ACT 38). The processor 71 controls the gate 38 so that the paper sheet is guided towards the cassette for reuse 21B. Therefore, the finisher 13 conveys the paper sheet the content of which has been erased by the erasing mechanism 35 to the cassette for reuse 21B (ACT 39).

If the image processing unit 58 has determined that the content of the paper sheet is not to be erased (i.e., the paper is rejected) (ACT 37, NO), the processor 51 notifies the processor 71 that the paper sheet is a reject paper sheet. After receiving the notice, the processor 71 of the finisher 13 controls the gate 38 so that the paper sheet passing through the erasing mechanism 35 is guided towards the reject cassette 39. Therefore, the finisher 13 transports the paper sheet to the reject cassette 39 (ACT 40).

After transporting the paper sheet to the cassette for reuse 21B or to the reject cassette 39, the processor 51 determines whether a paper sheet is in the paper discharge tray 31*a* (ACT 41). If the processor 51 determines that the paper sheet is in the paper discharge tray 31*a*, i.e., the paper sheet remains in the paper discharge tray 31*a* (ACT 41, YES), the operation process returns to ACT 34 and recovers the next paper sheet in the paper discharge tray 31*a*. If the processor 51 determines that no paper sheet is in the paper discharge tray 31*a*, i.e., no paper sheet remains in the paper discharge tray 31*a* (ACT 41, NO), the processor 51 commands the display unit 42 to display a message that the paper sheet in the paper discharge tray 31*a* has been recovered (ACT 42).

The image forming device applying the second recovery operation recovers the paper sheet in the paper discharge tray if a paper sheet is in the paper discharge tray at a predetermined recovery time. The image forming device, of the paper sheet that has been recovered from the paper discharge tray, stores the paper sheet for reuse in the cassette for reuse after erasing the image and stores the reject paper sheet in the reject cassette.

According to the image forming device applying the second recovery operation, the paper sheet that has been left unattended in the paper discharge tray can be recovered at the predetermined recovery time. As a result, the image forming device applying the second recovery operation can periodically recover the paper sheet in the paper discharge tray.

Next, the third recovery operation of the image forming device 1 will be explained.

The image forming device 1 that performs the third recovery operation prints identification information on the paper sheet, along with the image. The identification information on the paper sheet is a form that can be recognized by the image forming device. The identification information is information including a time period during which the image will not be erased (or the information regarding whether to erase the image or not). The identification information may include user identification information, an output (the printing operation) time, identification information of the printer (the external device), print setting information, and so forth, in addition to the time period during which the image will not be erased.

Specifically, the identification information to be printed on the paper sheet is a form that can be recognized by the scanner 34 disposed in the finisher 13 (the erasing unit 32). For example, the image processing unit 58 of the system control unit 50 has a function of recognizing the identification information from the image read by the scanner 34. The image forming device 1 prints, at a predetermined location (for example, the outside of the image printing area or the like) on the paper sheet, the form, such as letters, codes, a barcode and the like, as a form. In addition, the identification information may be a form that is not distinguishable to the human eye.

After receiving print data from an external device, the processor 51 stores the received print data in the HDD 55. The processor 51 creates the identification information from the information contained in the received print data. The processor 51 prints on the paper sheet the identification information and the image contained in the print data by the printer 12. The printer 12 discharges the paper sheet on which the image and the identification information have been printed to the paper discharge tray 31*a*. The sensor S detects the presence of the paper sheet in the paper discharge tray 31*a* (that is, whether or not the user has taken out the discharged paper sheet).

Figure 6:
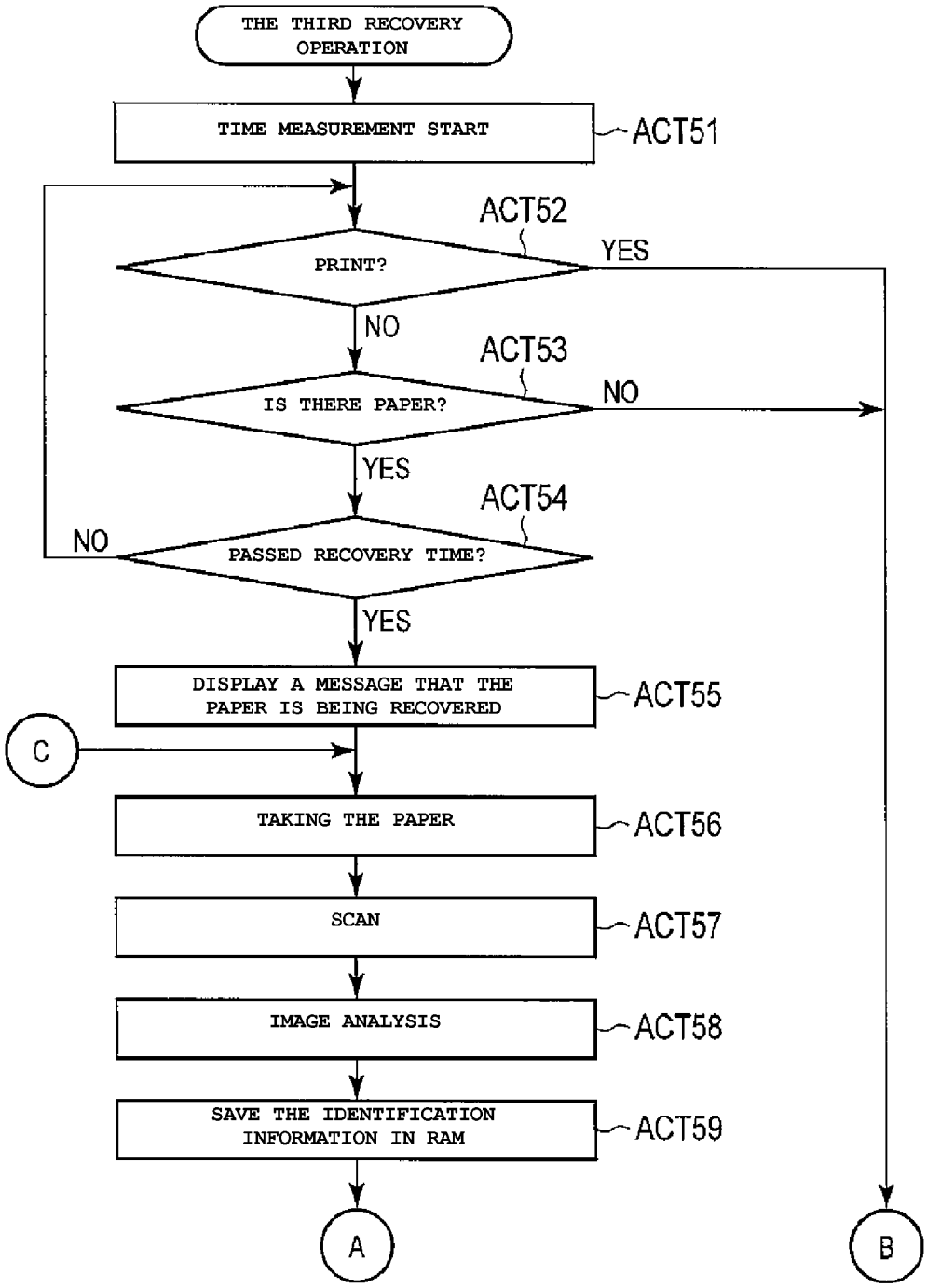
FIG. 6 is a flow chart for explaining an example of a third recovery operation of the image forming device.
Figure 7:
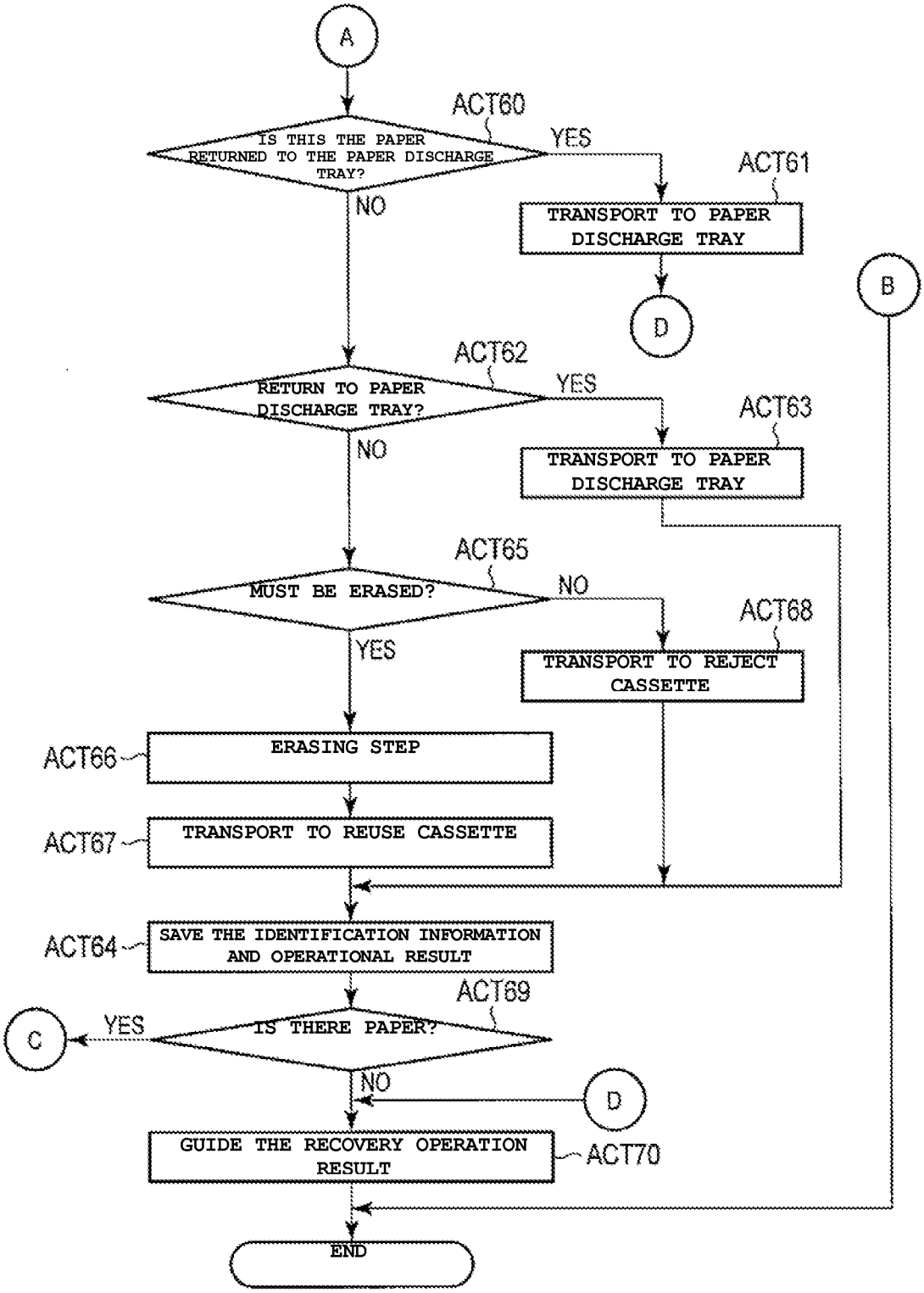
FIG. 7 is a flow chart for explaining the example of the third recovery operation of the image forming device.

FIG. 6 and FIG. 7 are flow charts for explaining the third recovery operation of the paper sheet in the image forming device 1.

In the example of the third recovery operation as shown in FIG. 6 and FIG. 7, the image forming device 1 recovers the paper sheet if the paper sheet remains in the paper discharge tray 31*a* for over a predetermined recovery time period. However, as the third recovery operation, the image forming device 1 may be configured to recover the paper sheet in the paper discharge tray 31*a* at a predetermined time (the recovery time).

After completing the printing process, the processor 51 of the system control unit 50 starts measuring an elapsed time using the clock 59 (ACT 51). The elapsed time is time that has elapsed since the printing process has completed. If the processor 51 controls to start a new printing process (ACT 52, YES), the processor 51 stops measuring the elapsed time and ends the recovery process. The processor 51 newly starts measuring the elapsed time and executes the recovery process each time the printing process ends.

If no printing process is carried out, i.e., during the idle time (ACT 52, NO), the processor 51 checks if a paper sheet is in the paper discharge tray 31*a* (ACT 53). For example, the processor 51 monitors the presence of the paper sheet in the paper discharge tray 31*a* according to the detection signal transmitted from the sensor S, which is provided in the paper discharge tray 31*a*. If no paper sheet is in the paper discharge tray 31*a* (ACT 53, NO), the processor 51 stops measuring the elapsed time (the recovery process).

If a paper sheet is in the paper discharge tray 31*a* (ACT 53, YES), the processor 51 checks whether or not the elapsed time exceeds a predetermined time (a recovery time) (ACT 54). The recovery time is a time period from the time the printing process ends (the time when the paper sheet is discharged to the paper discharge tray 31*a*) until the time the recovery of the paper sheet on the paper discharge tray 31*a* starts. If the elapsed time does not exceed the recovery time (ACT 54, NO), the operation process 51 returns to ACT 52 and the processor 51 checks whether a new printing process has started or not. Here, ACT 53 and ACT 54 may be reversed. Thus, the processor 51 may be configured to detect the presence of the paper sheet on the paper discharge tray 31*a* if the elapsed time exceeds the recovery time.

If the elapsed time exceeds the recovery time (ACT 54, YES), the processor 51 commands the display unit 42 to display a message that the recovery of the paper sheet on the paper discharge tray 31*a* has started (or the recovery step of the paper sheet is in progress) (ACT 55). In addition, if the elapsed time exceeds the recovery time (ACT 54, YES), the processor 51 commands the recovering mechanism 33 to convey (recover) the paper sheet on the paper discharge tray 31*a* to the finisher 13 (ACT 56). Specifically, the recovering mechanism 33 conveys the paper sheet to the scanner 34. The scanner 34 reads the image on the recovered paper sheet (ACT 57). The scanner 34 transfers to the system control unit 50 the image data (the data of the image read from the paper sheet). The image processing unit 58 of the system control unit 50 analyzes the image data of the paper sheet (ACT 58).

In the third recovery operation, the image processing unit 58 recognizes the identification information included in the image of the paper sheet read by the scanner 34 as an analyzing process. The image processing unit 58 notifies the processor 51 of the recognized identification information of the paper sheet (the recovered paper sheet). The processor 51 acquires from the image processing unit 58 the recognized result of the identification information of the paper sheet. The processor 51 retains in the RAM 52 the recognized result of the identification information of the recovered paper sheet (ACT 59).

After specifying the identification information, the processor 51 checks whether the now-recovered paper sheet has previously been returned to the paper discharge tray 31*a* (ACT 60). For example, in the step that will be mentioned later, the processor 51 saves the identification information and the operational result for each paper sheet in the HDD 55. The processor 51 determines whether the paper sheet has previously been returned to the paper discharge tray 31*a* by confirming whether the identification information saved in the HDD 55 matches the identification information printed on the paper sheet. The recovering mechanism 33 feeds the paper sheets from the bottom, if two or more paper sheets are stacked in the paper discharge tray 31*a*, and the reverse conveying path 36 is configured to discharge the paper sheet onto the top of the previously discharged, if any, paper sheets in the paper discharge tray 31*a*.

If the currently-recovered paper sheet has previously been returned to the paper discharge tray 31*a* (ACT 60, YES), the processor 51 instructs the processor 71 to return the currently-recovered paper sheet to the paper discharge tray 31*a* again. After receiving the instruction, the processor 71 controls the gate 37 so that the currently-recovered paper sheet is guided towards the reverse conveying path 36. As a result, the finisher 13 returns the currently-recovered paper sheet that has passed through the scanner 34 to the paper discharge tray 31*a* through the gate 37 and the reverse conveying path 36 (ACT 61). If the currently-recovered paper sheet has been returned to the paper discharge tray 31*a* again, the operation process proceeds to ACT 70 and the processor 51 controls to show a message that the paper sheet has been returned to the paper discharge tray 31*a*.

Furthermore, if the currently-recovered paper sheet has never been returned to the paper discharge tray 31*a* (ACT 60, NO), the processor 51 determines whether the currently-recovered paper sheet is to be returned to the paper discharge tray based on the identification information of the paper sheet recognized by the image processing unit 58 (ACT 62). For example, the identification information contains the information indicating a time period during which the image on the paper sheet is not to be erased. If the elapsed time since the paper sheet is printed does not reach the time period indicated with respect to the recovered paper sheet, the processor 51 determines that the paper sheet is to be returned to the paper discharge tray 31*a*.

If the processor 51 determines that the paper sheet is to be returned to the paper discharge tray 31*a* (ACT 62, YES), the processor 51 instructs the processor 71 so that the paper sheet is to be returned to the paper discharge tray 31*a*. After receiving the instruction, the processor 71 controls the gate 37 to guide the paper sheet towards the reverse conveying path 36. As a result, the finisher 13 conveys the paper sheet that has passed through the scanner 34 to the paper discharge tray 31*a* through the gate 37 and the reverse conveying path 36 (ACT 63).

The processor 51 commands the HDD 55 to save the information regarding the identification information of the paper sheet as well as the operational result with respect to the paper sheet (ACT 64). Thus, the information saved in the HDD 55 is the information pertaining to the paper sheet that has been recovered (the operational result and the identification information). By using the identification information saved in the HDD 55 as a reference, the processor 51 can verify the identification information of the paper sheet that has been returned to the paper discharge tray 31*a* if the paper sheet has been recovered again. Therefore, the processor 51 can identify the paper sheet that has been recovered again from the paper discharge tray. In addition, the processor 51 can determine the information regarding the number of paper sheets that have been recovered or the user who recovered the paper sheet based on the identification information of the recovered paper sheet (the information pertaining to the paper sheets that have been recovered), the information of which has been saved in the HDD 55.

If the processor 51 determines that the currently-recovered paper sheet is not to be returned to the paper discharge tray 31*a* again (ACT 62, NO), the processor 51 determines whether the content of the paper sheet is to be erased or not, based on the analyzed result of the image analyzed by the image processing unit 58 (ACT 65). If the processor 51 determines that the content of the currently-recovered paper sheet is to be erased (ACT 65, YES), the processor 51 instructs the processor 71 so that an erasing process is to be carried out on the paper sheet. After receiving the instruction, the processor 71 commands the erasing mechanism 35 to carry out the erasing process on the paper sheet (ACT 66). The processor 71 controls the gate 38 so that the paper sheet is guided towards the cassette for reuse 21B. As a result, the finisher 13 conveys to the cassette for reuse 21B the paper sheet that has undergone the erasing process (ACT 67).

If the processor 51 determines that the erasing process should not be performed on the currently-recovered paper sheet (the reject paper sheet) (ACT 65, NO), the processor 51 notifies the processor 71 that the paper sheet has been rejected. After receiving the notice, the processor 71 controls the gate 38 so that the paper sheet is guided towards the reject cassette 39. As a result, the finisher 13 conveys the paper sheet to the reject cassette 39 (ACT 67).

After the paper sheet has been conveyed to the cassette for reuse 21B or the reject cassette 39, the processor 51 commands the HDD 55 to save the information regarding the identification information of the paper sheet and the operational result with respect to the paper sheet (ACT 64). In addition, the processor 51 determines whether a paper sheet is put on the paper discharge tray 31*a* (ACT 69). If the processor 51 determines that a paper sheet is put on the paper discharge tray 31*a*, i.e., if a paper sheet is remaining on the paper discharge tray 31*a* (ACT 69, YES), the operation process returns to ACT 56 and the processor 51 recovers the next paper sheet on the paper discharge tray 31*a*.

In addition, if the processor 51 determines that no paper sheet is put on the paper discharge tray 31*a*, i.e., no paper sheet is remaining on the paper discharge tray 31*a* (ACT 69, NO), the processor 51 commands the display unit 42 to display a message that the paper sheet on the paper discharge tray 31*a* has been recovered (ACT 70). In the third recovery operation, the display unit 42 may be configured to display a message based on the operational result of the recovery process stored in the HDD 55, in addition to the message indicating that the paper sheet has been recovered.

Figure 8:
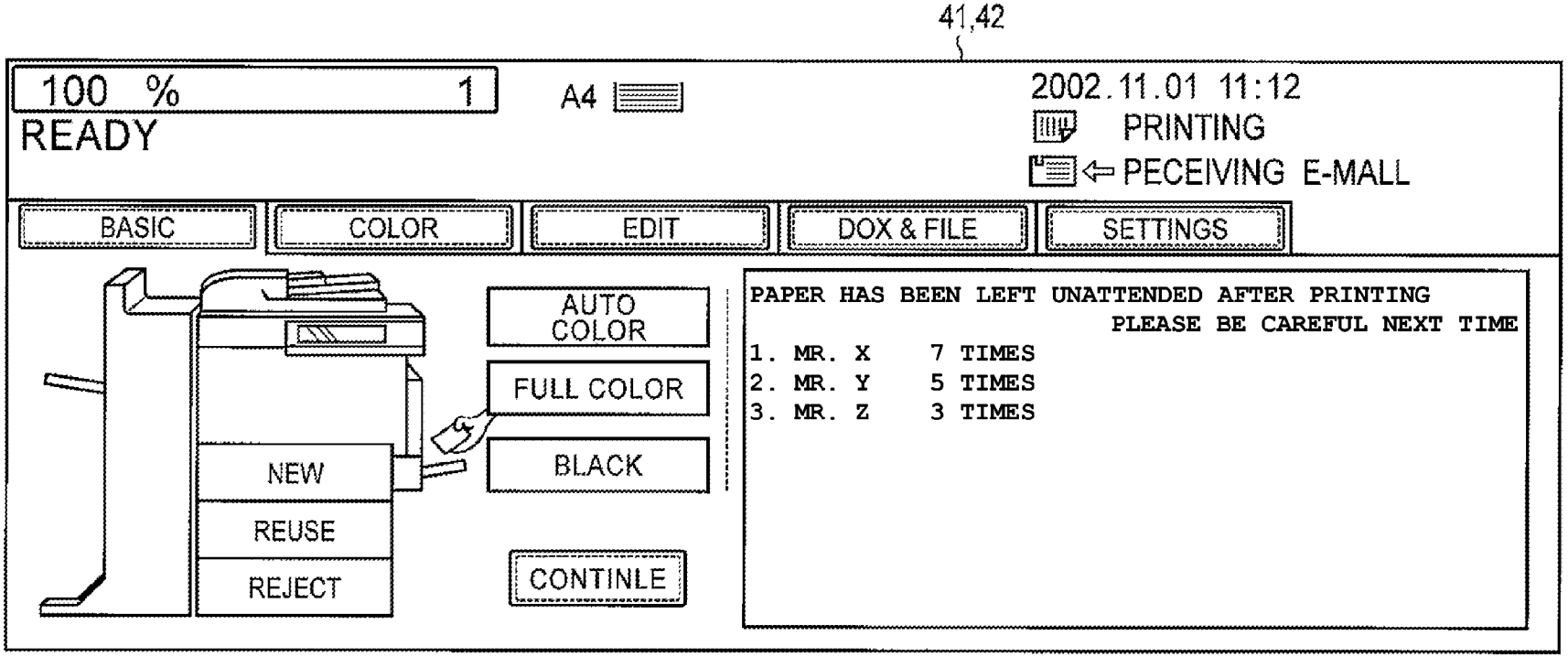
FIG. 8 is another example of a message displayed on the display unit.

FIG. 8 is an example of the message displayed on the display unit 42 in the third recovery operation.

In the example shown in FIG. 8, the display unit 42 of the control panel 14 displays a message that includes the user who left the printed paper sheet unattended and the frequency of doing so per user (the frequency of the paper sheet being recovered). The display unit 42 also displays a warning suggesting that the user be careful not to leave the printed paper sheet. The processor 51 makes the identification according to the identification information read from the paper sheet that has been recovered. The identification information of the paper sheet that has been recovered is memorized by the HDD 55. The processor 51 specifies the user who has left the paper sheet unattended (the user whose printed paper sheet has been recovered) and the frequency of leaving the paper sheet unattended per user, based on the identification information stored in the HDD 55. Thus, in the third recovery operation, the processor 51 can display a guidance pertaining to the paper sheet that has been recovered automatically from the paper discharge tray, based on the identification information stored in the HDD 55.

The image forming device that performed the third recovery operation recovers the paper sheet in the paper discharge tray if the predetermined recovery time has passed since the paper sheet is left unattended on the paper discharge tray. The image forming device reads the image on the recovered paper sheet and analyzes the read image of the paper sheet. The image forming device determines whether to return the paper sheet to the paper discharge tray. Further, if the image forming device decides not to return the paper sheet, then it decides whether to erase the image and hold the paper sheet in the cassette for reuse, or hold the paper sheet in the cassette for rejection, based on the analysis result of the read image of the recovered paper sheet.

The image forming device applying the third recovery operation can handle the paper sheet that has been printed and then left unattended in the paper discharge tray based on the identification information of the paper sheet. For example, the image forming device applying the third recovery operation not only recovers the paper sheet based on the predetermined conditions (exceeding the recovery time or the specific recovery time) but can also return to the paper discharge tray the paper sheet that meets the condition to not-to-be-erased as indicated by the identification information of the paper sheet. As a result, according to the image forming device applying the third recovery operation, the paper sheet that has been printed can be prevented from being left unattended in the paper discharge tray for a long period of time. Further, the processes corresponding to the identification information of each paper sheet is available.

While certain embodiments have been described, these embodiments have been presented by way of example only, and they are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming device, comprising:

a printing unit for printing an image on a sheet;

a holding unit for holding the sheet that has been printed by the printing unit;

a recovery unit for recovering the sheet from the holding unit;

an erasing unit for erasing the image on the sheet recovered by the recovery unit; and a control unit configured to command the recovery unit to recover the sheet held by the holding unit if a predetermined condition is met.

2. The image forming device according to claim 1, further comprising:

a sensor for detecting whether the sheet is held by the holding unit, wherein the control unit is configured to command the recovery unit to recover the sheet based on a detection result of the sensor.

3. The image forming device according to claim 2, wherein the control unit is configured to command the recovery unit to recover the sheet if a time period elapsed since the sheet is held by the holding unit reaches a predetermined time period.

4. The image forming device according to claim 2, wherein the control unit is configured to command the recovery unit to recover the sheet if a current time reaches a predetermined time.

5. The image forming device according to claim 1, further comprising:

a display unit for displaying the operational status of the image forming device, wherein the control unit is configured to command the display unit to display a message if the sheet is recovered from the holding unit.

6. The image forming device according to claim 1, further comprising:

a first container to store the sheets the image on which is erased by the erasing unit; and a second container to store the sheets having images that the control unit determines not to command the erasing unit to erase, wherein the gate is configured to guide the sheets to one of the first and second containers.

7. The image forming device according to claim 1, further comprising:

a scanner to scan the sheet recovered by the recovery unit, wherein the control unit is configured to determine whether to command the erasing unit to erase the image on the sheet based on the scanned result by the scanner.

8. The image forming device according to claim 7, further comprising:

a gate for switching a conveying path of the sheet based on whether the control unit has determined to command the erasing unit to erase the image on the sheet.

9. The image forming device according to claim 7, further comprising:

a returning mechanism to return the sheet recovered by the recovery unit to the holding unit, wherein the printing unit is configured to print an identification information that can be scanned by the scanner, and the control unit is configured to command the returning mechanism to return the sheet based on an identification information scanned by the scanner.

10. The image forming device according to claim 9, wherein the control unit is configured to command the returning mechanism to return the sheet if the time period shown by the identification information exceeds the a time period elapsed since the sheet is held by the holding unit.

11. A method for handling a sheet on which an image has been printed, comprising:

holding the sheet on which the image has been printed in a holding unit, recovering the sheet from the holding unit if a predetermined condition is met, and erasing the image on the recovered sheet.

12. The method according to claim 11, further comprising:

determining whether or not to erase the image on the sheet; and guiding the recovered sheet along one of multiple conveying paths based on said determining.

13. The method according to claim 11, further comprising:

detecting whether the sheet is held in the holding unit, wherein the sheet is recovered from the holding unit if a time period elapsed since the sheet is held by the holding unit reaches a predetermined time period.

14. The method according to claim 11, further comprising:

detecting whether the sheet is held in the holding unit, wherein the sheet is recovered from the holding unit if a current time reaches a predetermined time.

15. The method according to claim 11, further comprising:

displaying a message if the sheet is recovered from the holding unit.

16. A finishing device to be attached to a printing device, comprising:

a holding unit for holding a sheet on which an image has been printed by the printing device;

a recovery unit for recovering the sheet from the holding unit;

an erasing unit for erasing the image on the sheet recovered by the recovery unit; and a control unit configured to control the recovery unit so that the recovery unit recovers the sheet held by the holding unit if a predetermined condition is met.

17. The finishing device according to claim 16, further comprising:

a scanner to scan the sheet recovered by the recovery unit, wherein the control unit is configured to determine whether to command the erasing unit to erase the image on the sheet based on the scanned result by the scanner.

18. The finishing device according to claim 17, further comprising:

a gate for switching a conveying path of the sheet based on whether the control unit has determined to command the erasing unit to erase the image on the sheet.

19. The finishing device according to claim 16, further comprising:

a sensor for detecting whether the sheet is held in the holding unit, wherein the control unit is configured to command the recovery unit to recover the sheet based on a detection result of the sensor.

20. The image forming device according to claim 19, wherein the control unit is configured to command the recovery unit to recover the sheet if a time period elapsed since the sheet is held by the holding unit reaches a predetermined time period.

* * * * *